US008929584B2

(12) United States Patent
Zoellin et al.

(10) Patent No.: US 8,929,584 B2
(45) Date of Patent: Jan. 6, 2015

(54) COMPONENT HAVING A MICROMECHANICAL MICROPHONE STRUCTURE

(71) Applicants: Jochen Zoellin, Muellheim (DE); Christoph Schelling, Stuttgart (DE)

(72) Inventors: Jochen Zoellin, Muellheim (DE); Christoph Schelling, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/071,227

(22) Filed: Nov. 4, 2013

(65) Prior Publication Data

US 2014/0126762 A1 May 8, 2014

(30) Foreign Application Priority Data

Nov. 2, 2012 (DE) ..... 10 2012 220 006

(51) Int. Cl.
*H04R 25/00* (2006.01)

(52) U.S. Cl.
USPC ..... 381/429; 381/174; 381/357

(58) Field of Classification Search
USPC ..... 381/173–176, 355–358, 423, 429
See application file for complete search history.

(56) References Cited

U.S. PATENT DOCUMENTS

| | | | | |
|---|---|---|---|---|
| 2,521,744 | A * | 9/1950 | Pocock | 381/429 |
| 7,839,052 | B2 * | 11/2010 | Wu et al. | 381/429 |
| 8,311,264 | B2 * | 11/2012 | Lee | 381/429 |
| 8,750,554 | B2 * | 6/2014 | Sakamoto | 381/429 |
| 2012/0033831 | A1 | 2/2012 | Leitner | |

* cited by examiner

*Primary Examiner* — Suhan Ni
(74) *Attorney, Agent, or Firm* — Kenyon & Kenyon LLP

(57) ABSTRACT

Measures for dynamically regulating the microphone sensitivity of a MEMS microphone component at low frequencies by way of variable roll-off behavior are proposed. The micromechanical microphone structure of the component, which is implemented in a layer structure on a semiconductor substrate, encompasses an acoustically active diaphragm having leakage openings which spans a sound opening in the substrate back side, and a stationary acoustically permeable counterelement having through openings which is disposed in the layer structure above/below the diaphragm. The component furthermore encompasses a capacitor assemblage for signal sensing, having at least one deflectable electrode on the diaphragm and at least one stationary electrode on the counterelement, and an arrangement for implementing a relative motion between the diaphragm and counterelement parallel to the layer planes.

10 Claims, 2 Drawing Sheets

COMPONENT HAVING A MICROMECHANICAL MICROPHONE STRUCTURE

FIELD OF THE INVENTION

The present invention relates to a component having a micromechanical microphone structure that is implemented in a layer structure on a semiconductor substrate. The microphone structure encompasses an acoustically active diaphragm having leakage openings which spans a sound opening in the substrate back side, and a stationary acoustically permeable counterelement having through openings which is disposed in the layer structure above or below the diaphragm. The component is equipped with a capacitor assemblage for signal sensing, which encompasses at least one deflectable electrode on the diaphragm and at least one stationary electrode on the counterelement. In addition, an arrangement is provided for implementing a relative motion between the diaphragm and counterelement parallel to the layer planes.

BACKGROUND INFORMATION

Sound impingement onto the diaphragm occurs via the sound opening in the substrate and/or via the through openings in the counterelement. The diaphragm deflections resulting therefrom perpendicular to the layer planes are sensed, as changes in capacitances, with the aid of the capacitor assemblage.

The diaphragm structure reacts, however, not only to acoustic pressure but also to fluctuations in ambient pressure and to air-flow-related low-frequency pressure fluctuations such as those caused, for example, by wind. Spurious influences of this kind on the microphone signal can be reduced by a slow pressure equalization between the two sides of the diaphragm. The speed at which such a pressure equalization occurs depends substantially on the flow resistance of the corresponding flow paths. The lower the flow resistance, the more quickly a pressure equalization between the diaphragm front side and diaphragm back side takes place, and the less influence atmospheric pressure fluctuations and air flows have on the microphone signal. As the flow resistance decreases, however, so too does the microphone's sensitivity to low-frequency acoustic signals, referred to as the "roll-off" at low frequencies.

U.S. Published Patent Appln. No. 2012/0033831 describes a microphone component having variable roll-off behavior. The known microphone component encompasses an acoustically active diaphragm that functions as a movable electrode of a capacitor assemblage for signal sensing. Leakage openings for pressure equalization between the diaphragm front side and diaphragm back side are embodied in the diaphragm. The known microphone component furthermore encompasses a counterelement constituting a carrier of a stationary electrode off the capacitor assemblage. The counterelement is disposed at a distance from the diaphragm and has through openings, so that it is acoustically permeable. Because of the very short distance between the diaphragm and counterelement, in the case of the known microphone component the flow resistance between the front and back sides of the diaphragm depends substantially on the offset between the through openings of the counterelement and the leakage openings of the diaphragm, and can accordingly be varied in controlled fashion by a parallel displacement between the diaphragm and counterelement. This relative motion is produced with the aid of a drivable actuator arrangement, for example capacitively or piezoelectrically.

Although the roll-off behavior of the known microphone component can in this manner be dynamically adapted to the ambient situation, the overall sensitivity of the known microphone component is nevertheless very limited. This is attributable to the very short distance d between the diaphragm and counterelement.

The mechanical sensitivity of the diaphragm of a microphone component can be appreciably increased by application of a bias voltage. The closer this bias voltage $U_{bias}$ is to the so-called "pull-in" voltage $U_{pull\text{-}in}$ (i.e. the voltage at which the return force of the diaphragm is overcome and the diaphragm is pulled against the counterelement), the greater the acoustic sensitivity of the diaphragm. The pull-in voltage $U_{pull\text{-}in}$ rises with the distance between the diaphragm and counterelement, specifically as a power of 3/2. The sensitivity of a microphone component correspondingly also rises with the distance d, specifically as a power of 1/2, when the diaphragm is acted upon by a bias voltage $U_{bias}$ close to the pull-in voltage $U_{pull\text{-}in}$.

With the known microphone component, however, the distance d between the diaphragm and counterelement cannot be increased arbitrarily if the roll-off behavior is to be varied by a parallel displacement between the diaphragm and counterelement. The greater the distance d, or gap, between the diaphragm and counterelement, the lower the flow resistance in the gap becomes. The influence exerted on the roll-off behavior of the known microphone component by the offset between the through openings in the counterelement and the leakage openings in the diaphragm thus also becomes less as the distance d increases. Especially when the distance d between the diaphragm and counterelement is on the order of the diameter of the through openings in the counterelement, the flow resistance in the gap becomes so low that the alignment of the through openings in the counterelement and the leakage openings in the diaphragm has practically no further influence on the roll-off behavior of the known microphone component.

SUMMARY

The present invention further develops the microphone element with variable roll-off behavior known from U.S. Published Patent Appln. No. 2012/0033831 in order to improve the overall microphone sensitivity.

According to the present invention, the counterelement of such a microphone component is equipped for that purpose with a stop structure which is designed so that the number of leakage openings in the diaphragm that are overlapped by the stop structure depends on the relative position between the diaphragm and counterelement. According to the present invention, the degree of overlap between the stop structure and the assemblage of leakage openings can thus be modified in controlled fashion by a parallel displacement between the diaphragm and counterelement.

With the microphone component according to the present invention, the flow resistance upon pressure equalization between the diaphragm front side and diaphragm back side is determined substantially by the degree of overlap between the stop structure and the leakage openings. The magnitude of the distance d between the diaphragm and counterelement plays only a subordinate role in this context, so that, in particular, greater distances d can also be implemented in order to increase the microphone sensitivity. The stop structure can moreover be used as a support for the biased diaphragm, and as an overload protector in the operating mode.

There are in principle many possibilities for implementing a microphone component according to the present invention, in particular with regard to the layout of the diaphragm having the leakage openings and the layout of the counterelement.

In a preferred embodiment of the invention, the disposition of the leakage openings and the layout of the stop structure are coordinated with one another in such a way that in an initial position of the diaphragm and counterelement only a few leakage openings (if any) are overlapped by the stop structure of the counterelement, and the number of overlapped leakage openings rises as the parallel displacement between the diaphragm and counterelement proceeds, at least up to a predefined offset between the diaphragm and counterelement. In this case the flow resistance between the two sides of the diaphragm can easily be regulated by way of the offset between the diaphragm and counterelement.

The leakage openings and the corresponding stop structures are preferably disposed in the edge region of the diaphragm in order to make available the largest possible continuous, highly movable, diaphragm area for sound reception.

As already mentioned previously, the sensitivity of a microphone component can increased by mechanically biasing the microphone diaphragm. In a preferred embodiment of the invention, the capacitor assemblage is used for this purpose for signal sensing, by the fact that an electrical bias voltage $U_{bias}$ is applied between the diaphragm and counterelement, the result of which is that the diaphragm is electrostatically deflected. This electrostatic deflection of the diaphragm can of course also be brought about using a capacitor assemblage that is provided for the purpose and is not used for signal sensing, or also with arrangements of other kinds, for example with the aid of piezo actuators. In any case, the diaphragm can in this fashion be acted upon in controlled fashion with a mechanical bias, and pulled against the stop structure of the counterelement.

A particularly high flow resistance can be achieved with a stop structure that encompasses a continuous sealing ring. The center region of the diaphragm can thereby be peripherally sealed acoustically. Alternatively or also in supplementary fashion thereto, it is often advantageous if the stop structure encompasses peg-like and/or finger-like structural elements whose disposition and geometry are adapted to the disposition and shape of the corresponding leakage openings in the diaphragm.

The parallel displacement between the diaphragm and the counterelement of the microphone component according to the present invention can also be implemented in various ways.

In a particularly advantageous embodiment of the invention, the counterelement is incorporated into the layer structure via a resilient mount that enables a rotational or translational motion of the counterelement parallel to the layer planes, but does not permit any "out-of-plane" motion of the counterelement. In this case the counterelement is displaced within the layer plane, i.e. parallel to the diaphragm, by controlled driving of the resilient mount. The resilient mount is advantageously driven capacitively. This variant is appropriate in particular when the counterelement with its resilient elements has been patterned out of a thick epi-polysilicon layer of the layer structure. In this case even relatively large-area electrodes of a corresponding capacitor assemblage can be implemented in the epi-polysilicon layer, for example in the form of mutually interengaging comb electrodes. The resilient mount of the counterelement can, however, be driven in a different manner, for example using a piezo actuator.

Alternatively or also as a supplement thereto, the diaphragm can also be displaced in the layer plane, i.e. parallel to the counterelement. In this case the resilient mount of the diaphragm is designed so that it allows not only out-of-plane motion resulting from acoustic pressure, but also an "in-plane" motion. In addition, as in the case of the drivable resilient mount of the counterelement, an arrangement for a controlled production of such a lateral motion is provided.

Particularly high microphone sensitivity can also be achieved, in the context of the microphone component according to the present invention, with a so-called flexural beam diaphragm, i.e. a diaphragm that is incorporated into the layer structure of the component only via a resilient element similar to a strut or flexural beam, and that consequently, in response to sound, deflects chiefly in plane-parallel fashion and is in practice does not become warped. Lateral movability of the diaphragm can furthermore be implemented by way of constrictions in the flexural beam so that it can be utilized for the parallel displacement between the diaphragm and counterelement.

Ideally, the flow resistance between the two sides of the diaphragm, or the air leakage rate, can be regulated as a function of the ambient conditions of the microphone component, specifically during operation, in order to achieve consistently good microphone performance even in varying ambient conditions. A preferred embodiment of the microphone component according to the present invention is therefore equipped with an arrangement for regulating the relative position between the diaphragm and counterelement as a function of the occurrence and intensity of low-frequency pressure fluctuations.

DETAILED DESCRIPTION

Figure 1A:
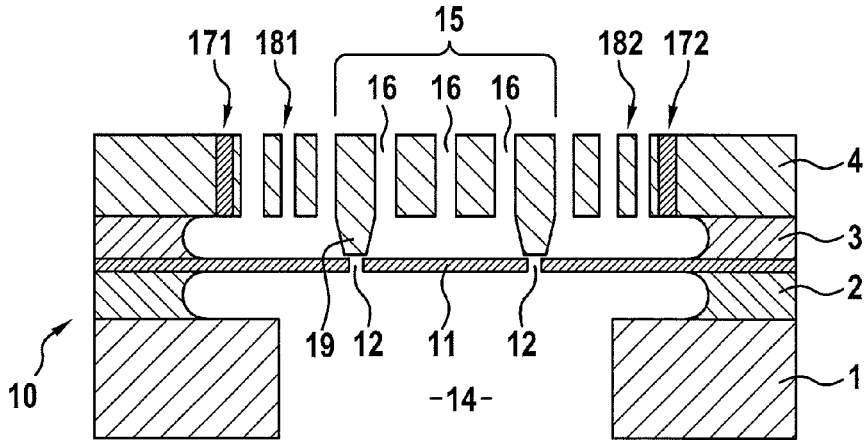
FIG. 1*a* is a schematic sectioned view through a first microphone component 10 according to the present invention with the counterelement in an idle position, so that the stop structure of the counterelement overlaps the leakage openings in the diaphragm.
Figure 1B:
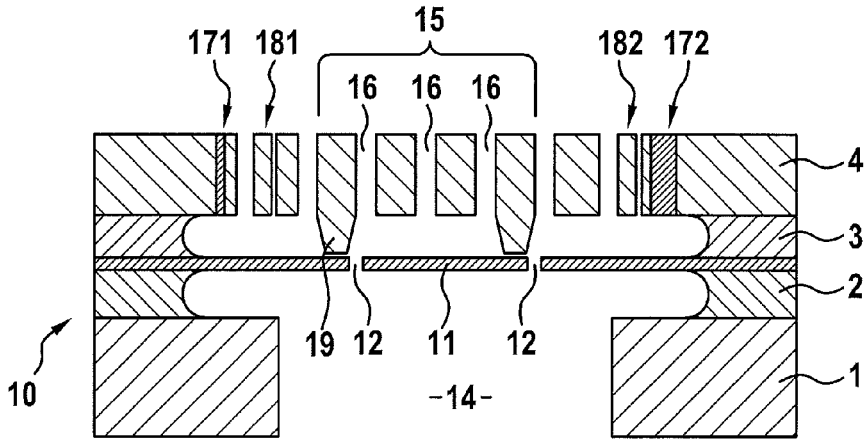
FIG. 1*b* is a schematic sectioned view through said microphone component 10 with the counterelement displaced in parallel fashion, so that the leakage openings in the diaphragm are open.

The microphone structure of the MEMS microphone component 10 depicted in FIGS. 1*a* and 1*b* is implemented in a layer structure on a semiconductor substrate 1, for example on a silicon substrate. It encompasses an acoustically active diaphragm 11 having leakage openings 12 which spans a sound opening 14 in the substrate back side, and a stationary acoustically permeable counterelement 15 having through openings 16 which is disposed in the layer structure above diaphragm 11. Diaphragm deflections resulting from acoustic pressure are sensed capacitively, in which context diaphragm 11 functions as a movable electrode and the stationary counterelement 15 is equipped with an immovable electrode of a microphone capacitor assemblage.

In the present exemplifying embodiment, the diameter of diaphragm 11 is greater than the cross-sectional area of sound opening 14. Diaphragm 11 is incorporated peripherally into the layer structure of component 10, so that diaphragm 11 is continuous over sound opening 14 except for leakage openings 12. Diaphragm 11 is electrically insulated by corresponding intermediate layers 2 and 3 of the layer structure with respect to substrate 1 on the one hand, and with respect to a thick epi-polysilicon layer 4 on the other hand.

Counterelement 15 was patterned out of said epi-polysilicon layer 4 together with a resilient mount made up of two resilient elements 171 and 172 and the associated actuator components 181 and 182. Resilient mount 171, 172 and actuator components 181, 182 extend, just like counterelement 15, over the entire thickness of epi-polysilicon layer 4. This resilient mount 171, 172 also correspondingly allows only an in-plane deflection of counterelement 15, i.e. in the layer plane. Resilient mount 171, 172 is flexurally stable perpendicularly to the layer planes, so that counterelement 15 is not deflected by acoustic pressure. Also contributing to this are through openings 16 in counterelement 15. Counterelement 15 is furthermore equipped with a stop structure 19 for diaphragm 11, which in the exemplifying embodiment depicted here is implemented in the form of a peripheral sealing ring 19 at the edge of counterelement 15.

Stop structure 19 (i.e. in this case sealing ring 19) is designed according to the present invention so that the degree of overlap of stop structure 19 and leakage openings 12 depends on the relative position between diaphragm 11 and counterelement 15. In the present exemplifying embodiment this relative position can be varied by an in-plane deflection of counterelement 15. For this, resilient elements 171 and 172 are driven in controlled fashion with the aid of the corresponding actuator components 181 and 182. Actuator components 181, 182 can be, for example, capacitor comb structures having an asymmetrical electrode position in the idle state, so that a directed motion in only one preferred direction is brought about by application of a voltage.

The microphone structure of component 10 depicted in FIGS. 1*a* and 1*b* is designed so that the degree of overlap between stop structure 19 of counterelement 15 and leakage openings 12 in diaphragm 11 is greatest when counterelement 15 is in its idle position, i.e. when the actuator mechanism on resilient mount 171, 172 is not being actuated. This situation is depicted in FIG. 1*a*. Here both resilient elements 171, 172 are in the same stress state. The flow resistance between the two sides of the diaphragm is maximal. This operating mode is adapted to a normal ambient situation with no low-frequency interference noise, and provides good microphone performance with a high signal-to-noise ratio.

Upon occurrence of large low-frequency pressure fluctuations, leakage openings 12 are exposed by way of a parallel displacement of counterelement 15, in order to decrease the flow resistance between the two sides of diaphragm 11 and thus also to decrease the microphone's sensitivity to low-frequency interference noise. This situation is depicted in FIG. 1*b*, where resilient element 171 on the left side of counterelement 15 is compressed, while resilient element 172 on the right side of counterelement 15 is elongated.

This adaptation or modulation of the acoustic leakage flow resistance usefully occurs automatically whenever a previously defined threshold value for the occurrence of large low-frequency pressure fluctuations is exceeded. This can be done, for example, by monitoring the total sound level summed over all frequencies below 200 Hz, and defining for it a threshold value of >50 dB. The acoustic leakage flow resistance can then be regulated as a function of this total sound level by way of a parallel displacement of counterelement 15. FIGS. 1*a* and 1*b* show microphone component 10 during a regulation operation of this kind, since diaphragm 11 is not respectively biased in this case.

This is because for signal sensing, diaphragm 11 is biased, and pulled against stop structure 19, by application of a voltage $U_{bias}$ between diaphragm 11 and counterelement 15. The result thereof is to increase the mechanical sensitivity of diaphragm 11 and the acoustic sealing effect of stop structure 19, which has as a whole a positive effect on microphone performance. In order to modulate the leakage flow resistance, however, this voltage $U_{bias}$ applied between diaphragm 11 and counterelement 15 is switched off in order to release diaphragm 11 from stop structure 19 and thus enable a parallel displacement of counterelement 15. Only thereafter is diaphragm 11 biased again by re-applying voltage $U_{bias}$.

Figure 2A:
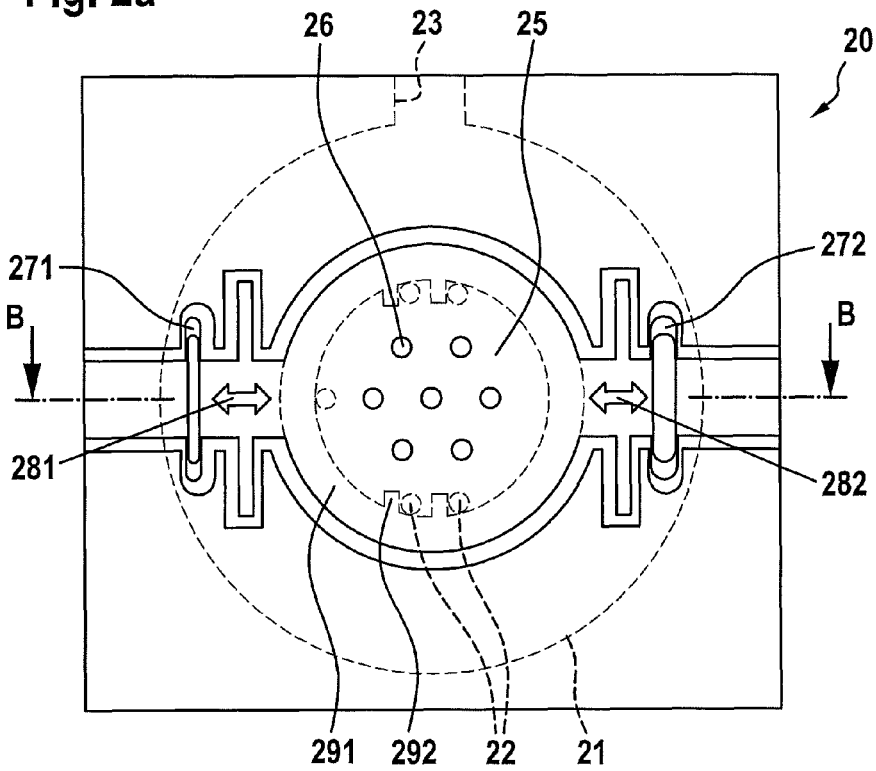
FIG. 2*a* is a plan view of a second microphone component 20 according to the present invention with the counterelement displaced in parallel fashion.
Figure 2B:
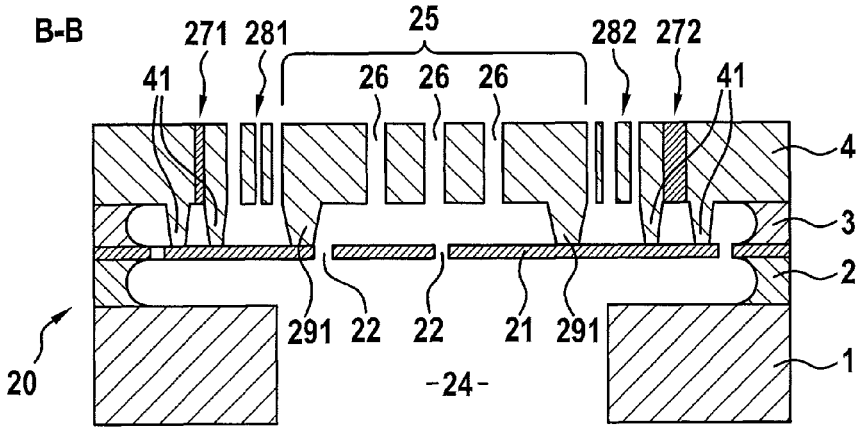
FIG. 2*b* is a schematic sectioned view through said microphone component 20.

The microphone structure of the MEMS microphone component 20 depicted in FIGS. 2*a* and 2*b* is also implemented in a layer structure on a semiconductor substrate 1. It encompasses an acoustically active diaphragm 21 having leakage openings 22 which spans a sound opening 24 in the substrate back side, and a stationary acoustically permeable counterelement 25 having passthrough openings 26 which is disposed in the layer structure above diaphragm 21. Diaphragm 21 serves as a deflectable electrode of a microphone capacitor assemblage for signal sensing, and is electrically insulated by corresponding intermediate layers 2 and 3 of the layer structure with respect to substrate 1 on the one hand and with respect to a thick epi-polysilicon layer 4 on the other hand. Counterelement 25 having the stationary electrode of the microphone capacitor assemblage is embodied in this epi-polysilicon layer 4.

In the present exemplifying embodiment, diaphragm 21 is a circular flexural-beam diaphragm that is incorporated on only one side, via a flexural beam 23, into the layer structure of component 20.

The plan view of FIG. 2*a* illustrates the layout of counterelement 25, which has been patterned out of epi-polysilicon layer 4 together with its resilient mount, resilient elements 271, 272, and associated actuator components 281, 282. As in the case of microphone component 10, all these components 25, 271, 272, 281, and 282 extend over the entire thickness of epi-polysilicon layer 4. The circular counterelement 25 is attached to epi-polysilicon layer 4, and thus incorporated into the layer structure of component 20, only at two oppositely located edge segments, in each case via a respective actuator component 281 and 282 and a respective resilient element 271 and 272. This layout makes possible a translational motion of counterelement 25 along the axis of resilient mount 271 and 272, i.e. within the layer plane. Resilient mount 271, 272 is flexurally stable perpendicular to the layer planes, so that counterelement 25 having through openings 26 in the center region is acoustically permeable.

Counterelement 25 is equipped with a stop structure for diaphragm 21, which can be made of an insulating material. The sectioned view of FIG. 2*b* illustrates the fact that this stop structure encompasses a continuous sealing ring 291 embodied at the edge of counterelement 25, as well as peg-like structural elements 292, as is evident from FIG. 2*a*. These structural elements 292 are disposed on the inner edge of sealing ring 291 in correspondence with the positions of individual leakage openings 22 in diaphragm 21. The stop structure (i.e. in this case sealing ring 291 and structural elements 292) are designed according to the present invention in such a way that the degree of overlap between stop structure 291, 292 and leakage openings 22 depends on the relative position between diaphragm 21 and counterelement 25. This can be modified in controlled fashion by way of a translational motion of counterelement 25. This purpose is served by the drivable actuator components 281 and 282, which interact with resilient mount 271, 272 of counterelement 25.

In the case of microphone component 20 depicted here, the microphone structure is again designed so that the degree of overlap between stop structure 291, 292 of counterelement 25 and leakage openings 22 in diaphragm 21 is greatest when counterelement 25 is in its idle position, i.e. the two resilient elements 271 and 272 are in the same stress state. This operating mode with maximum leakage flow resistance is adapted to a normal ambient situation with no low-frequency interference noise, and provides good microphone performance with a high signal-to-noise ratio.

FIGS. 2*a* and 2*b* show the operating mode of microphone component 20 upon occurrence of large low-frequency pressure fluctuations, when leakage openings 22 in diaphragm 21 have been exposed by a translational motion of counterelement 25 in order to decrease the flow resistance between the two sides of diaphragm 21, and thus also to decrease the microphone's sensitivity to low-frequency noise. Resilient element 271 on the left side of counterelement 25 is in this case compressed, while resilient element 272 on the right side of counterelement 25 is elongated.

In order to decrease the leakage flow via the diaphragm edge and resilient elements 271, 272, microphone component 20 is equipped with a further sealing structure 41 that is implemented here in the form of two sealing rings disposed concentrically with respect to counterelement 25 and to sealing ring 281.

In conclusion, be it noted once again that the present invention not only can be implemented in the context of microphone components having a front-plate counterelectrode, as described above with reference to the exemplifying embodiments, but can just as easily be realized with microphone components having a back-plate counterelectrode.

What is claimed is:

1. A component having a micromechanical microphone structure that is implemented in a layer structure on a semiconductor substrate, comprising:

an acoustically active diaphragm having leakage openings which span a sound opening in a backside of the substrate;

a stationary acoustically permeable counterelement having through openings disposed in the layer structure one of above and below the diaphragm;

a capacitor assemblage for signal sensing, having at least one deflectable electrode on the diaphragm and at least one stationary electrode on the counterelement; and an arrangement for implementing a relative motion between the diaphragm and the counterelement parallel to layer planes of the layer structure, wherein:

the counterelement includes a stop structure for the diaphragm so that at least one of a number and a degree of overlap of the leakage openings that are overlapped by the stop structure depends on a relative position between the diaphragm and the counterelement, and can be modified in a controlled fashion by a parallel displacement between the diaphragm and the counterelement.

2. The component as recited in claim 1, wherein a disposition of the leakage openings, and the stop structure of the counterelement, are such that the number of overlapped leakage openings successively increases by way of one of a directed parallel displacement and rotation from an initial position up to a predefined offset between the diaphragm and the counterelement.

3. The component as recited in claim 1, wherein the leakage openings are disposed in an edge region of the diaphragm.

4. The component as recited in claim 1, further comprising:

an arrangement with which the diaphragm can be selectively impinged upon by a mechanical bias, and can selectably be pulled against the stop structure of the counterelement.

5. The component as recited in claim 1, wherein the stop structure includes a continuous sealing ring with which the diaphragm can be peripherally acoustically sealed.

6. The component as recited in claim 1, wherein the stop structure includes at least one of peg-like structural elements and finger-like structural elements having a disposition and a geometry adapted to a disposition and shape of corresponding leakage openings in the diaphragm.

7. The component as recited in claim 1, further comprising:

a resilient mount via which the counterelement is incorporated into the layer structure, the resilient mount enabling a motion of the counterelement parallel to the layer planes; and an arrangement for driving the resilient mount.

8. The component as recited in claim 1, wherein a mounting of the diaphragm is such that the mounting allows an out-of-plane motion of the diaphragm resulting from an acoustic pressure, and a lateral motion of the diaphragm parallel to the layer planes, the component comprising an arrangement for a controlled production of the lateral motion.

9. The component as recited in claim 1, wherein the diaphragm includes a flexural beam diaphragm that is incorporated into the layer structure only on one side via a flexural beam.

10. The component as recited in claim 1, further comprising:

an arrangement for regulating the relative position between the diaphragm and the counterelement as a function of an occurrence and an intensity of low-frequency pressure fluctuations.

* * * * *